United States Patent [19]

Humpa

[11] 3,934,915

[45] Jan. 27, 1976

[54] DISPOSABLE UTILITY TONGS

[76] Inventor: Norbert J. Humpa, 100 Aspen Drive, Schaumburg, Ill. 60172

[22] Filed: Mar. 9, 1973

[21] Appl. No.: 339,930

[52] U.S. Cl. ..... 294/16; 81/43; 294/33; 294/99 R

[51] Int. Cl.[2] ..... B25B 9/02

[58] Field of Search ..... 294/99 R, 33, 25, 16; 81/43

[56] References Cited

UNITED STATES PATENTS

| | | | |
|---|---|---|---|
| 832,317 | 10/1906 | Hinds | 294/99 R X |
| 985,755 | 2/1911 | Gilbert | 294/99 R |
| 2,685,880 | 8/1954 | Curutchet | 294/106 X |
| 3,137,880 | 6/1964 | Kubit et al. | 294/99 R X |
| 3,265,068 | 8/1966 | Holohan | 294/99 R X |

*Primary Examiner*—Evon C. Blunk
*Assistant Examiner*—Jeffrey V. Nase
*Attorney, Agent, or Firm*—John J. Swartz

[57] ABSTRACT

A one-piece set of synthetic plastic, object-gripping tongs including a pair of longitudinally extending blades, an integral hinge normally urging the blades to fully spread positions, but permitting movement thereof to closed, object-gripping positions, and cooperating connector portions on the blades interrupting spreading movement of the blades in positions between the fully spread and closed positions, but permitting movement thereof to the closed positions.

10 Claims, 4 Drawing Figures

DISPOSABLE UTILITY TONGS

BACKGROUND OF THE INVENTION

This invention relates to a one-piece set of disposable or throw-away tongs for gripping ice and the like, and a method of making the throw-away tongs.

Many commercial establishments, such as airlines, prepare and serve consumable products with throw-away serving pieces. To accommodate the service of iced beverages aboard commercial aircraft, the commercial airlines currently store stainless steel ice tongs. The disposal of the relatively expensive stainless steel tongs after a one-time use represents a substantial expenditure. Accordingly, it is an object of the present invention to provide a set of relatively inexpensive throw-away utility tongs and method of making such utility tongs.

In the manufacture of ice tongs, it is important that the number of pieces in the construction be minimized so that the attendant assembly costs are also minimized. Prior art tong constructions which incorporated a blade spreading hinge, have not been entirely satisfactory because the hinge does not always retain its "spring", and, after limited use, the object-gripping blades would sometimes not be automatically restored to their fully spread, object-receiving positions. Continued use of such tongs was only possible if the blades were manually spread and this interfered with the efficient working of the tongs.

Later tong constructions included spring members reacting between the object-gripping blades to normally urge the blades to spread positions so that an object could be easily received therebetween, but permitting movement thereof to closed object-gripping positions. This, of course, increased the manufacturing costs.

Previous plastic tong constructions have a relatively small object biting or gripping portion which inhibits the gripping of objects. Accordingly, it is another object of the present invention to provide utility tongs of the type described which can hold an object along a substantial portion of its length.

Low packaging and shipping costs are important factors in a profitable ice tong business. In the high volume, low margin, ice tong industry, packaging and shipping charges can represent a substantial percentage of the total overhead. Although conventional ice tongs are not particularly heavy, they are bulky and this greatly adds to the packaging and shipping costs. Accordingly, it is an object of the present invention to provide a method of making ice tongs which permits them to be compactly stacked for shipment.

A further object of the present invention is to provide a set of ice tongs which can be easily, finally assembled at the point of use.

SUMMARY OF THE INVENTION

A set of tongs constructed according to the present invention comprises a pair of longitudinally extending blades having free ends mounting confronting, object-gripping teeth, a hinge connected to the other ends of the blades yieldably urging the blades to fully spread positions in prolongation of each other, but permitting movement of the blades to closed positions in which the teeth grip opposite sides of an object. Connecting apparatus is provided to interrupt spreading movement of the blades in positions intermediate the spread and closed positions, so that the blades are generally coextensive, but permitting movement of the blades to the closed positions to grip an object.

The tongs are manufactured by molding a one-piece, elongate blank of synthetic plastic, having teeth at opposite ends of one side of the blank, and then folding the blank so that the teeth are in confronting relation and keeping the blank in the folded condition with a male-female type connector which prevents return of the blank to its unfolded condition.

Other objects and advantages of the present invention will become apparent to those of ordinary skill in the art by the following description when considered in relation to the accompanying drawings, in which.

DESCRIPTION OF THE PREFERRED EMBODIMENT

Figure 1:
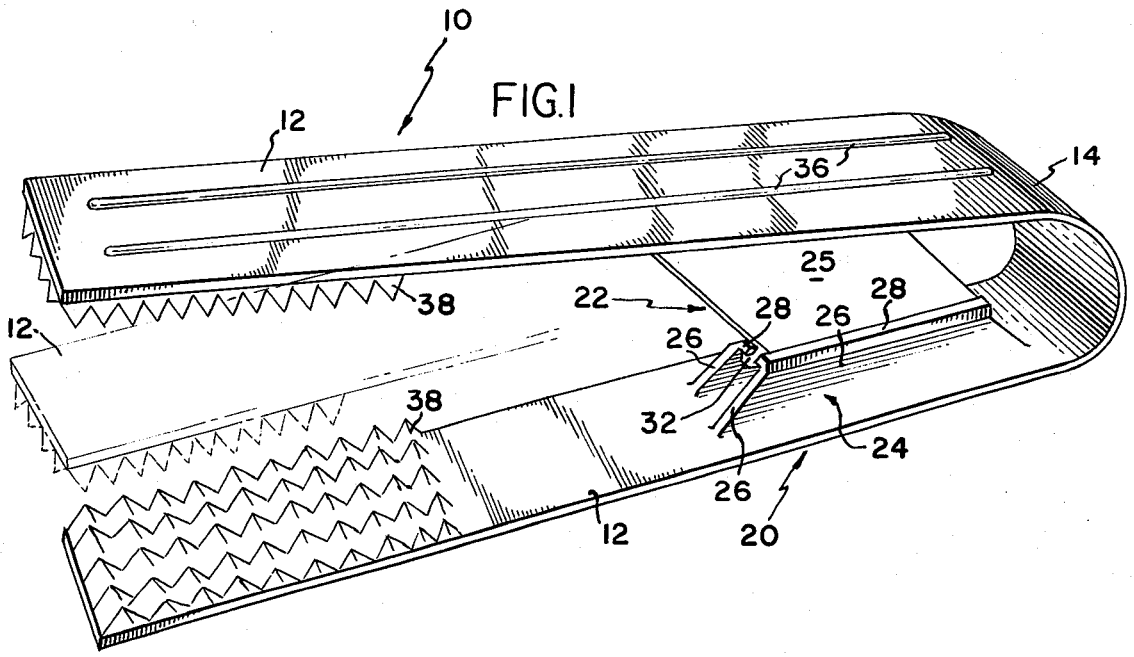
FIG. 1 is a perspective side view of the tongs constructed according to the present invention.
Figure 2:
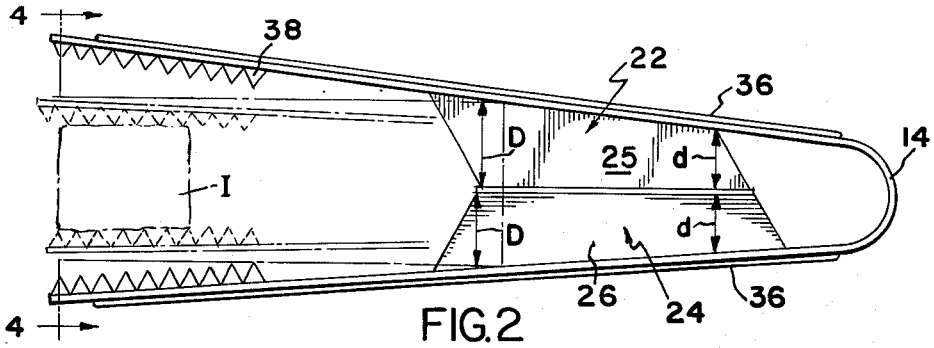
FIG. 2 is a slightly reduced, side elevational view of the tongs illustrated in FIG. 1.
Figure 3:
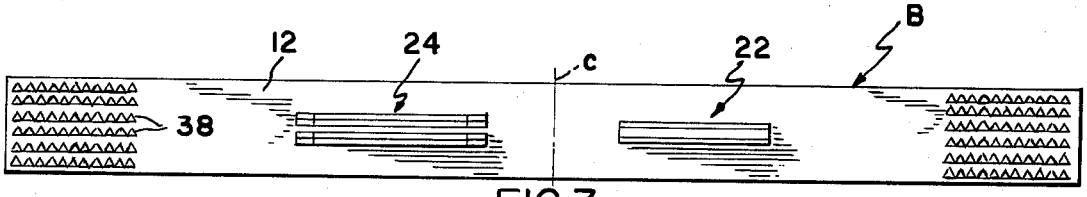
FIG. 3 is a more reduced, top plan view illustrating the tongs in an unfolded condition during an initial stage of manufacture.

A set of tongs constructed according to the present invention is generally designated 10, and is particularly adapted for gripping an ice cube, generally designated I (FIG. 2). The ice tongs 10 include a pair of generally longitudinal, coextensive blades 12 connected by an integral, curvilinear hinge portion, generally designated 14, normally urging the blades 12 toward unfolded positions in which the blades substantially lie in the same plane and are in prolongation of each other in prolongation of each other, as illustrated in FIG. 3, but permitting movement thereof to engaging positions, illustrated in chain lines in FIG. 1.

The blades 12 are held in the positions illustrated in FIG. 2 by a keeper, generally designated 20, including a male latch or a connector member, generally designated 22, and a latch receiving, female connector member, generally designated 24. The latch receiving member 24 includes a pair of inwardly projecting plates or walls 26, integral with one of the blades 12, having confronting terminal flange portions 28 spaced from each other by a gap 30 for receiving the male latch member 22. The male latch member 22 includes an inwardly projecting plate 25, integral with the other blade 12, terminating in a laterally extending flange or catch 32. Inwardly converging cam surfaces 34 are provided on the catch 32 for camming the female flange portions 28 to the spread positions, illustrated in chain lines in FIG. 4, when the blades 12 are moved from the positions in prolongation of each other (FIG. 3) to the confronting positions (FIGS. 1 and 2) so that the catch 32 can be moved to the position illustrated in FIG. 4, underlying the female flange portions 28. The catch 32 will preclude the blades 12 from being spread beyond the positions illustrated in FIG. 2, but will permit movement of the blades 12 toward each other to the engaged positions illustrated in chain lines in FIG. 1.

As is best illustrated in FIG. 2, the distance *d* between the blades 12 and the juncture of catch 32 and flange portions 28 at the inner end of the keeper 20 is substantially less than the distance D between each blade 12 and the juncture of catch 32 and flange portions 28 at the outer end of the keeper 20.

The blades 12, which are normally held in positions in which they diverge toward their free ends, include a pair of longitudinally extending, integral, reinforcing ribs 36 on the outsides thereof. The reinforcing ribs 36 rigidify and strengthen the blades 12 so that the ice tongs 10 may be used to break clusters of ice cubes and the like. The free ends of the blades 12 include a plurality of rows of integral teeth 38 on the insides thereof in confronting relation with the teeth 38 on the opposite blade 12. The teeth 38 are pyramidally shaped and are so spaced relative to each other that the teeth 38 on the one blade are interjacent the teeth on the opposite blade to provide optimum gripping characteristics. The blades 12 may have a length of 5 inches, for example, and a thickness of 0.35 to 0.040 inches. The teeth extend along a substantial portion, i.e., 2 inches, of the blades 12.

METHOD OF MANUFACTURING

The tongs are manufactured by molding a one-piece elongate blank, generally designated B (FIG. 3), including the identical blade portions 12, in prolongation of each other, connected by the hinge portion 14. The tongs are manufactured from polypropylene or polyethylene material, having a built-in "memory" or spring-back characteristic which normally tends to urge the blades 12 to positions lie in the same plane as illustrated in FIG. 3 in prolongation of each other, but permits movement thereof to the generally coextensive, engaging positions illustrated in chain lines in FIG. 2.

Figure 4:
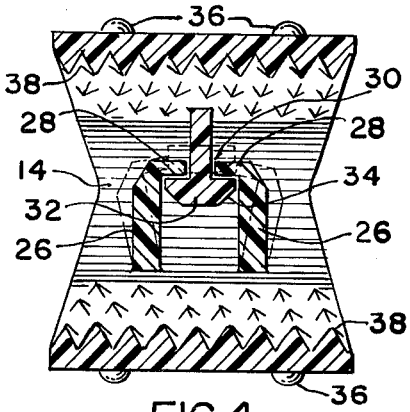
FIG. 4 is a sectional end view of the tongs, taken along the line 4—4 of FIG. 2.

The blank B is molded with the male latch member 22 in an upstanding position on one side of a centerline *c* and the female latch receiving members 26 in upstanding positions on the opposite side of the centerline *c*. The object-gripping blades 12 are folded about the centerline *c* so that the teeth 38 are moved to confronting positions, and the cam surfaces 34 on the catch 32 spread the female latch receiving members 26 to the spread positions, illustrated in chain lines in FIG. 4, permitting the catch 32 to be received between the latch receiving members 26. The female connector 24, receiving the male connector 22, allows the tongs to both open and close within set parameters, depending upon its application. A relatively unskilled assembly worker can rapidly fold the molded blank B, so that the blades 12 are removably coupled together, as illustrated in FIGS. 2 and 4, without looking at the tongs. Moreover, this construction enables the blanks B to be compactly stacked and shipped in the "flat" condition, illustrated in FIG. 3, to minimize packaging and shipping costs.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A one-piece set of synthetic plastic tongs for releasably gripping an object, such as an ice cube or the like comprising:

a pair of longitudinally extending blades having free ends mounting, confronting, object gripping teeth;

hinge means integrally connected with the other ends of said blades, normally urging said blades to spread positions in which said blades lie substantially in the same plane, but permitting movement of said blades to closed positions in which said blades are generally coextensive and said teeth grip opposite sides of an object; and means carried by the blades for interrupting spreading movement of said blades in less spread positions intermediate said spread positions and said closed positions but permitting movement of said blades to said closed, object-gripping positions.

2. The one-piece set of plastic tongs of claim 1 wherein said interrupting means includes latch means integral with one of said blades and spreadable latch receiving means, integral with the other one of said blades, spreadable to receive said latch means and prevent said blades from moving to said spread positions, but permitting movement to said closed positions.

3. The one-piece set of tongs of claim 2 wherein said spreadable means comprises a pair of laterally spaced, inwardly projecting members on said other blade having confronting flange means; said latch means including means on said one blade for spreading said flange means to permit said latch means to be received between said confronting flange means to a position underlying said flange means.

4. The one-piece set of tongs of claim 3 wherein said laterally spaced members are laterally yieldable and said latch member includes laterally, outwardly directed flange portions underlying said flange means in such a manner that the distance between said opposed blades normally increases from said other blade ends to said free blade ends.

5. The tongs set forth in claim 3 wherein the distance from said one blade to said laterally outwardly directed flange portion becomes increasingly greater from said one end to said other end.

6. The set of tongs of claim 5 wherein said blades include integral, longitudinal, reinforcing ribs extending along the outer sides thereof.

7. The one-piece set of tongs of claim 1 wherein said teeth on each blade comprise a plurality of longitudinally and laterally offset teeth members which are spaced so as to be interjacent the teeth members on the other blade.

8. The tongs set forth in claim 7 wherein said blades, said teeth members, said hinge means and said interrupting means are integral.

9. The tongs of claim 7 wherein the teeth on each blade comprise a plurality of rows of individual, pyramidally-shaped teeth members spaced so as to be interjacent the teeth members on the other blade.

10. A tong construction comprising:

a one-piece blade including blade portions connected by a hinge portion normally urging the blade portions to positions in which they lie in the same plane but permitting movement thereof to generally coextensive positions in which opposite ends thereof are engaging each other; and keeper means on said blade portions for preventing movement of said blade portions to said positions in which they lie in the same plane of each other but permitting movement of said blade portions to said engaging positions.

* * * * *